US011927381B2

(12) United States Patent
Tashiro et al.

(10) Patent No.: US 11,927,381 B2
(45) Date of Patent: Mar. 12, 2024

(54) AIR-CONDITIONING APPARATUS

(71) Applicant: Mitsubishi Electric Corporation, Tokyo (JP)

(72) Inventors: Yusuke Tashiro, Tokyo (JP); Yasuhide Hayamaru, Tokyo (JP); Masakazu Kondo, Tokyo (JP); Masakazu Sato, Tokyo (JP); Naoki Nakagawa, Tokyo (JP); Atsushi Kawashima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 167 days.

(21) Appl. No.: 16/961,005

(22) PCT Filed: Jan. 26, 2018

(86) PCT No.: PCT/JP2018/002475

§ 371 (c)(1),
(2) Date: Jul. 9, 2020

(87) PCT Pub. No.: WO2019/146071

PCT Pub. Date: Aug. 1, 2019

(65) Prior Publication Data

US 2021/0080160 A1 Mar. 18, 2021

(51) Int. Cl.

| | |
|---|---|
| ***F25B 5/02*** | (2006.01) |
| ***F25B 41/20*** | (2021.01) |
| ***F25B 47/02*** | (2006.01) |

(52) U.S. Cl.

CPC ..... *F25B 5/02* (2013.01); *F25B 41/20* (2021.01); *F25B 47/02* (2013.01); *F25B 2300/00* (2013.01); *F25B 2347/021* (2013.01)

(58) Field of Classification Search

CPC . F25B 47/02; F25B 2300/00; F25B 2347/021
See application file for complete search history.

(56) References Cited

U.S. PATENT DOCUMENTS 4,313,313 A * 2/1982 Chrostowski ..... F25B 47/022 62/278
4,644,758 A * 2/1987 Maehara ..... F25B 5/02 62/278

(Continued)

FOREIGN PATENT DOCUMENTS

JP H09-014816 A 1/1997
JP H10-089817 A 4/1998

(Continued)

OTHER PUBLICATIONS

Office Action dated Jul. 5, 2021, issued in corresponding CN Patent Application No. 201880086512.0 (and English Machine Translation).

(Continued)

*Primary Examiner* — David J Teitelbaum
(74) *Attorney, Agent, or Firm* — POSZ LAW GROUP, PLC

(57) ABSTRACT

When a controller performs a defrosting operation in which frost on an outdoor heat exchanger is caused to be melted, the controller is configured to perform a first defrosting control in which a switching state of a switching device is set to a first state, after the controller performs the first defrosting control, perform a second defrosting control in which the switching state of the switching device is set to a second state, and after the controller performs the second defrosting control, perform a third defrosting control in which the switching state of the switching device is set to the first state.

10 Claims, 10 Drawing Sheets

(56) References Cited

U.S. PATENT DOCUMENTS

| | | | | |
|---|---|---|---|---|
| 5,771,699 | A * | 6/1998 | Ponder | F25B 13/00 62/81 |
| 5,823,006 | A * | 10/1998 | Jung | F24F 3/065 62/291 |
| 5,839,292 | A | 11/1998 | Hwang | |
| 6,244,057 | B1 * | 6/2001 | Yoshida | F25B 47/025 62/278 |
| 2010/0170270 | A1 * | 7/2010 | Jang | F25B 13/00 62/81 |
| 2010/0251741 | A1 | 10/2010 | Yoshimi et al. | |
| 2015/0300723 | A1 * | 10/2015 | Tsukino | F25B 47/025 62/128 |
| 2016/0370045 | A1 * | 12/2016 | Takenaka | F28D 1/0443 |
| 2017/0153050 | A1 * | 6/2017 | Nakagawa | F25B 41/20 |
| 2019/0032979 | A1 * | 1/2019 | Kasamatsu | F28D 20/0056 |

FOREIGN PATENT DOCUMENTS

| | | | |
|---|---|---|---|
| JP | 2009-133578 | A | 6/2009 |
| JP | 4272224 | B2 | 6/2009 |

OTHER PUBLICATIONS

International Search Report of the International Searching Authority dated Mar. 27, 2018 for the corresponding international application No. PCT/JP2018/002475 (and English translation).

Japanese Office Action dated Mar. 9, 2021, issued in corresponding JP Patent Application No. 2019-567492 (and English Machine Translation).

Extended European Search Report dated Dec. 14, 2020, issued in corresponding European Patent Application No. 18902790.7.

Office Action dated Apr. 19, 2023 issued in corresponding European Patent Application No. 18902790.7.

* cited by examiner

AIR-CONDITIONING APPARATUS

CROSS REFERENCE TO RELATED APPLICATION

This application is a U.S. national stage application of PCT/JP2018/002475 filed on Jan. 26, 2018, the contents of which are incorporated herein by reference.

TECHNICAL FIELD

The present disclosure relates to a refrigeration cycle apparatus, and particularly to a refrigeration cycle apparatus that performs a defrosting operation in which frost formed on a heat exchanger is caused to be melted.

BACKGROUND ART

For some refrigeration cycle apparatuses, a refrigeration cycle apparatus is proposed that includes an indoor heat exchanger and an outdoor heat exchanger, the indoor heat exchanger being used as a condenser during a heating operation, the outdoor heat exchanger including a lower heat exchanger and an upper heat exchanger (for example, see Patent Literature 1). The upper heat exchanger is provided at a top of the lower heat exchanger. During the period when the refrigeration cycle apparatus of Patent Literature 1 performs the heating operation, the lower heat exchanger and the upper heat exchanger are used as evaporators and, as a result, frost is formed on the lower heat exchanger and the upper heat exchanger. Frost formed on a heat exchanger often inhibits heat exchange between refrigerant flowing through a heat transfer tube of the heat exchanger and air passing through the heat exchanger. Therefore, when frost is formed on the outdoor heat exchanger, the refrigeration cycle apparatus of Patent Literature 1 performs a defrosting operation in which frost on the outdoor heat exchanger is caused to be melted.

The defrosting operation of the refrigeration cycle apparatus of Patent Literature 1 includes upper defrosting and lower defrosting. During the upper defrosting, the indoor heat exchanger is used as a condenser, and defrosting of the upper heat exchanger is performed. During the lower defrosting, the indoor heat exchanger is used as a condenser, and defrosting of the lower heat exchanger is performed. The lower heat exchanger is used as an evaporator during the upper defrosting, and the upper heat exchanger is used as an evaporator during the lower defrosting. As described above, the indoor heat exchanger is used as a condenser during the upper defrosting and the lower defrosting and hence, warm air is supplied into a room from the indoor unit even during the period when the refrigeration cycle apparatus of Patent Literature 1 performs the defrosting operation.

CITATION LIST

Patent Literature

Patent Literature 1: Japanese Patent No. 4272224

SUMMARY OF INVENTION

Technical Problem

During the period when the refrigeration cycle apparatus of Patent Literature 1 performs the upper defrosting, water produced through melting on the upper heat exchanger flows down from the upper heat exchanger to the lower heat exchanger. At this point of operation, the lower heat exchanger is used as an evaporator and hence, water flowing down from the upper heat exchanger to the lower heat exchanger is frozen on the lower heat exchanger. Therefore, the thickness of the frost on the lower heat exchanger at the time of starting the lower defrosting may be increased compared with the thickness of frost on the lower heat exchanger at the time of starting the upper defrosting. When the thickness of frost formed on the lower heat exchanger increases, an amount of frost not in contact with the lower heat exchanger, which is a heat source, increases by the corresponding amount. Therefore, when the thickness of frost formed on the lower heat exchanger increases, defrosting efficiency of the lower heat exchanger is reduced during the lower defrosting. Accordingly, in the refrigeration cycle apparatus of Patent Literature 1, there may be a case where, at the time of finishing the lower defrosting, an amount of frost remaining unmelted on the lower heat exchanger increases. When the amount of frost remaining unmelted on the lower heat exchanger increases, heat exchange between refrigerant in the heat transfer tube of the lower heat exchanger and air passing through the lower heat exchanger is inhibited by the corresponding degree. As a result, efficiency of the heating operation restarted after the defrosting operation is reduced.

The present disclosure has been made to solve the above-mentioned problem, and it is an object of the present disclosure to provide a refrigeration cycle apparatus that can suppress a reduction in efficiency of the heating operation.

Solution to Problem

A refrigeration cycle apparatus of an embodiment according to the present disclosure includes a compressor; an indoor heat exchanger used as a condenser during a heating operation; an outdoor heat exchanger including a lower heat exchanger and an upper heat exchanger provided at top of the lower heat exchanger, the outdoor heat exchanger being used as an evaporator during the heating operation; a pressure reducing device provided downstream of the indoor heat exchanger in a direction in which refrigerant flows during the heating operation, the pressure reducing device being provided upstream of the outdoor heat exchanger in the direction in which refrigerant flows during the heating operation; a switching device configured to switch a switching state to one of a first state and a second state, a discharge port of the compressor and the lower heat exchanger being connected to each other in the first state, the discharge port of the compressor and the upper heat exchanger being connected to each other in the second state; and a controller configured to control the switching state of the switching device. When the controller performs a defrosting operation in which frost on the outdoor heat exchanger is caused to be melted, the controller is configured to perform a first defrosting control in which the switching state of the switching device is set to the first state, after the controller performs the first defrosting control, perform a second defrosting control in which the switching state of the switching device is set to the second state, and after the controller performs the second defrosting control, perform a third defrosting control in which the switching state of the switching device is set to the first state.

Advantageous Effects of Invention

In the refrigeration cycle apparatus of an embodiment according to the present disclosure, the first defrosting control is performed before the second defrosting control is performed and hence, frost on the lower heat exchanger is prevented from having a large thickness at the time of starting the third defrosting control and, as a result, it is possible to suppress a reduction in efficiency of the heating operation.

DESCRIPTION OF EMBODIMENTS

Embodiment

An embodiment will be described hereinafter with reference to the drawings. Note that, in the following drawings, the size relationship between components may differ from that of the actual apparatus. Forms of the components described in the entire specification are merely examples, and are not limited to such descriptions.

<Configuration of Embodiment>

Figure 1:
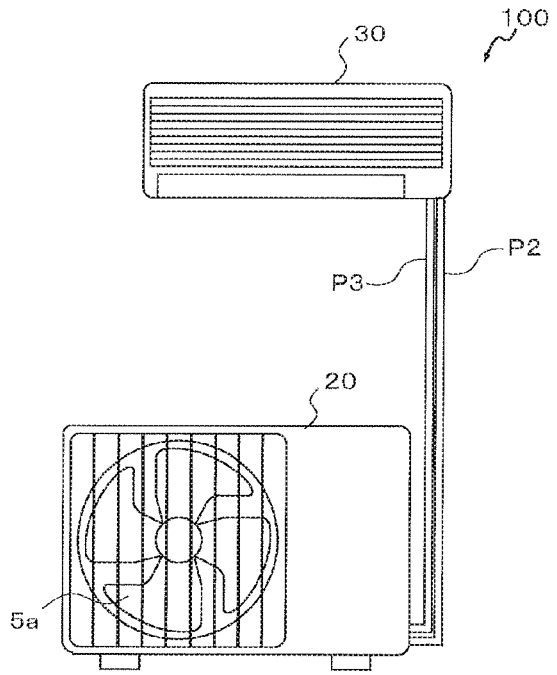
FIG. 1 is a schematic configuration diagram of a refrigeration cycle apparatus 100 according to an embodiment.
Figure 2:
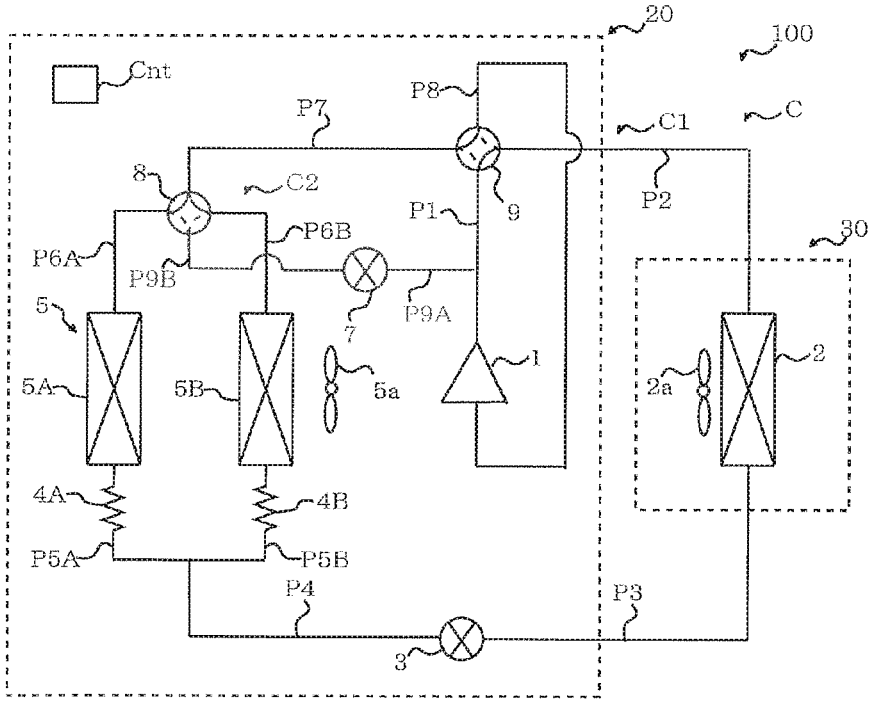
FIG. 2 is a refrigerant circuit diagram of the refrigeration cycle apparatus 100 according to the embodiment.
Figure 3:
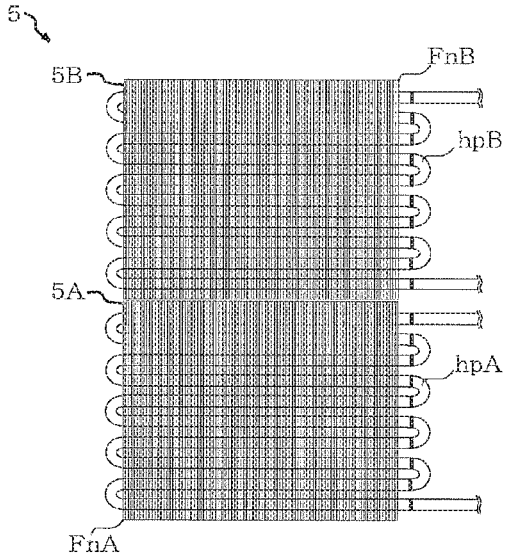
FIG. 3 is a schematic view of an outdoor heat exchanger 5.

FIG. 1 is a schematic configuration diagram of a refrigeration cycle apparatus 100 according to the embodiment. FIG. 2 is a refrigerant circuit diagram of the refrigeration cycle apparatus 100 according to the embodiment. FIG. 3 is a schematic view of an outdoor heat exchanger 5. As shown in FIG. 1, the refrigeration cycle apparatus 100 includes an outdoor unit 20 and an indoor unit 30, the outdoor unit 20 including the outdoor heat exchanger 5, the indoor unit 30 being connected to the outdoor unit 20 via a pipe P2 and a pipe P3. In the embodiment, the refrigeration cycle apparatus 100 is an air-conditioning apparatus. The refrigeration cycle apparatus 100 can perform a heating operation, a cooling operation, and a defrosting operation. In the heating operation, the outdoor heat exchanger 5 is used as an evaporator. In the cooling operation, the outdoor heat exchanger 5 is used as a condenser. In the defrosting operation, frost formed on the outdoor heat exchanger 5 during the heating operation is caused to be melted.

The outdoor unit 20 includes a compressor 1, a pressure reducing device 3, the outdoor heat exchanger 5, an outdoor fan 5*a*, and a flow passage switching valve 9. The compressor 1 compresses refrigerant. The pressure reducing device 3 reduces the pressure of refrigerant. The outdoor heat exchanger 5 is used as an evaporator during the heating operation. The outdoor fan 5*a* supplies air to the outdoor heat exchanger 5. The flow passage switching valve 9 is provided to a pipe connected to a discharge port of the compressor 1. The pressure reducing device 3 is provided downstream of an indoor heat exchanger 2 in a direction in which refrigerant flows during the heating operation, and the pressure reducing device 3 is provided upstream of the outdoor heat exchanger 5 in the direction in which refrigerant flows during the heating operation. As shown in FIG. 3, the outdoor heat exchanger 5 includes a lower heat exchanger 5A, and an upper heat exchanger 5B provided at top of the lower heat exchanger 5A, The volume of the lower heat exchanger 5A and the volume of the upper heat exchanger 5B are equal to each other. The lower heat exchanger 5A includes plate-shaped fins FnA and a heat transfer tube hpA provided to the fins FnA, refrigerant flowing through the heat transfer tube hpA. The upper heat exchanger 5B includes plate-shaped fins FnB and a heat transfer tube hpB provided to the fins FnB, refrigerant flowing through the heat transfer tube hpB. The outdoor unit 20 also includes a capillary tube 4A connected to the lower heat exchanger 5A, and a capillary tube 4B connected to the upper heat exchanger 5B. The outdoor unit 20 also includes a switching device 8 connected to the outdoor heat exchanger 5, and a valve 7 that can open and close. The switching device 8 is a valve that switches a switching state between a first state, a second state, and a third state. In the first state, the discharge port of the compressor 1 and the lower heat exchanger 5A are connected to each other. In the second state, the discharge port of the compressor 1 and the upper heat exchanger 5B are connected to each other. In the third state, the outdoor heat exchanger 5 and the flow passage switching valve 9 are connected to each other. The outdoor unit 20 further includes a controller Cnt that controls various actuators such as the compressor 1. The indoor unit 30 includes the indoor heat exchanger 2 and an indoor fan 2*a*. The indoor heat exchanger 2 is used as a condenser during the heating operation. The indoor fan 2*a* supplies air to the indoor heat exchanger 2.

The refrigeration cycle apparatus 100 includes a refrigerant circuit C including the compressor 1, the indoor heat exchanger 2, the pressure reducing device 3, and the outdoor heat exchanger 5, The refrigerant circuit C includes a main circuit C1 and a bypass C2. The main circuit C1 includes the compressor 1, the flow passage switching valve 9, the indoor heat exchanger 2, the pressure reducing device 3, the capillary tube 4A, the capillary tube 4B, the outdoor heat exchanger 5, and the switching device 8. The bypass C2 includes the valve 7. The bypass C2 bypasses the indoor heat exchanger 2 and the pressure reducing device 3 among the components of the main circuit C1.

The main circuit C1 includes a pipe P1, the pipe P2, the pipe P3, and a pipe P4. The pipe P1 connects the discharge port of the compressor 1 and the flow passage switching valve 9 to each other. The pipe P2 connects the flow passage switching valve 9 and the indoor heat exchanger 2 to each other. The pipe P3 connects the indoor heat exchanger 2 and the pressure reducing device 3 to each other. The pipe P4 is connected downstream of the pressure reducing device 3 in the direction in which refrigerant flows during the heating operation. The main circuit C1 also includes a pipe P5A, a pipe P5B, a pipe P6A, and a pipe P6B. The pipe P5A connects the pipe P4 and the capillary tube 4A to each other. The pipe P5B connects the pipe P4 and the capillary tube 4B to each other. The pipe P6A connects the lower heat exchanger 5A and the switching device 8 to each other. The pipe P6B connects the upper heat exchanger 5B and the switching device 8 to each other. The main circuit C1 further includes a pipe P7, and a pipe P8. The pipe P7 connects the switching device 8 and the flow passage switching valve 9 to each other. The pipe P8 connects the flow passage switching valve 9 and a suction port of the compressor 1 to each other. The bypass C2 includes a bypass pipe P9A and a bypass pipe P9B. The bypass pipe P9A connects the pipe P1 and the valve 7 to each other. The bypass pipe P9B connects the valve 7 and the switching device 8 to each other. The bypass pipe P9A and the bypass pipe P9B connect the discharge port of the compressor 1 and the switching device 8 to each other.

Figure 4:
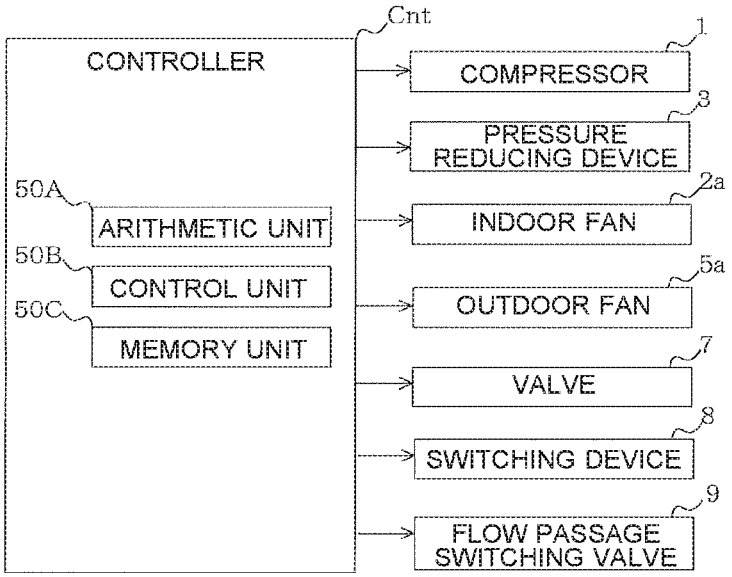
FIG. 4 is a block diagram of a control function of the refrigeration cycle apparatus 100 according to the embodiment.

FIG. 4 is a block diagram of a control function of the refrigeration cycle apparatus 100 according to the embodiment.

The controller Cnt includes an arithmetic unit 50A that performs an arithmetic operation, a control unit 50B that controls actuators, and a memory unit 500 that stores data. The arithmetic unit 50A is configured to compare a time elapsed from the start of various operations, such as the heating operation, and a predetermined threshold. The control unit 50B controls the compressor 1, the pressure reducing device 3, the indoor fan 2*a*, the outdoor fan 5*a*, the valve 7, the switching device 8, and the flow passage switching valve 9. Data, such as a threshold, used when the operation is shifted from the heating operation to the defrosting operation is stored in the memory unit 50C.

Each function unit included in the controller Cnt is made of dedicated hardware, or a micro processing unit (MPU) that performs a program stored in the memory. In the case where the controller Cnt is made of dedicated hardware, the controller Cnt corresponds to, for example, a single circuit, a composite circuit, an application specific integrated circuit (ASIC), a field-programmable gate array (FPGA), or a combination of these circuits. Each of the function units implemented by the controller Cnt may be implemented by individual hardware, or the function units may be implemented by one hardware. In the case where the controller Cnt is made of MPU, each function performed by the controller is implemented by software, firmware, or a combination of software and firmware. The software or the firmware is referred to as the program, and is stored in the memory unit 500. The MPU reads and executes the program stored in the memory to implement each function of the controller Cnt. The memory unit 50 is made of a nonvolatile or volatile semiconductor memory, such as a RAM, a ROM, a flash memory, an EPROM, and an EEPROM.

<Action of Embodiment>

Figure 5:
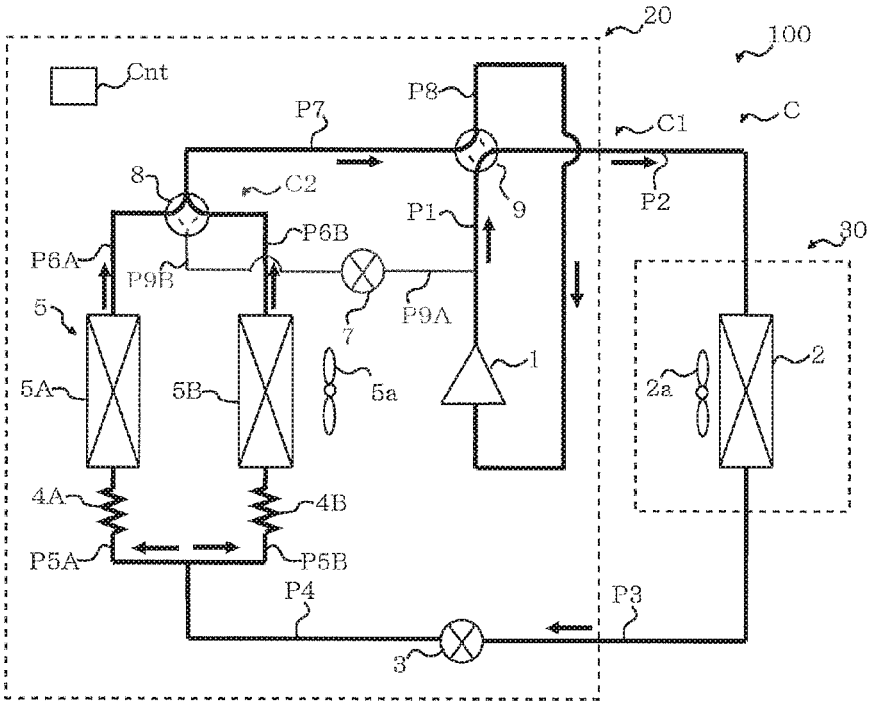
FIG. 5 is an action explanatory view of a heating operation of the refrigeration cycle apparatus 100 according to the embodiment.

FIG. 5 is an action explanatory view of the heating operation of the refrigeration cycle apparatus 100 according to the embodiment. In FIG. 5, the switching state of the switching device 8 is set to the third state. That is, the switching device 8 connects the lower heat exchanger 5A and the flow passage switching valve 9 to each other, and connects the upper heat exchanger 5B and the flow passage switching valve 9 to each other. In FIG. 5, the flow passage switching valve 9 connects the discharge port of the compressor 1 and the indoor heat exchanger 2 to each other, and connects the switching device 8 and the suction port of the compressor 1 to each other. In FIG. 5, the valve 7 is in a closed state. In FIG. 5, the indoor fan 2*a* and the outdoor fan 5*a* are operated. Refrigerant discharged from the compressor 1 passes through the flow passage switching valve 9 and, subsequently, flows into the indoor heat exchanger 2. The refrigerant flowing into the indoor heat exchanger 2 is liquefied. The pressure of the refrigerant flowing out from the indoor heat exchanger 2 is reduced by the pressure reducing device 3. The refrigerant whose pressure is reduced by the pressure reducing device 3 is in a two-phase gas-liquid state. The refrigerant flowing out from the pressure reducing device 3 flows into the outdoor heat exchanger 5. The refrigerant flowing into the outdoor heat exchanger 5 is gasified. The refrigerant flowing out from the outdoor heat exchanger 5 passes through the flow passage switching valve 9 and, subsequently, returns to the compressor 1.

Figure 6:
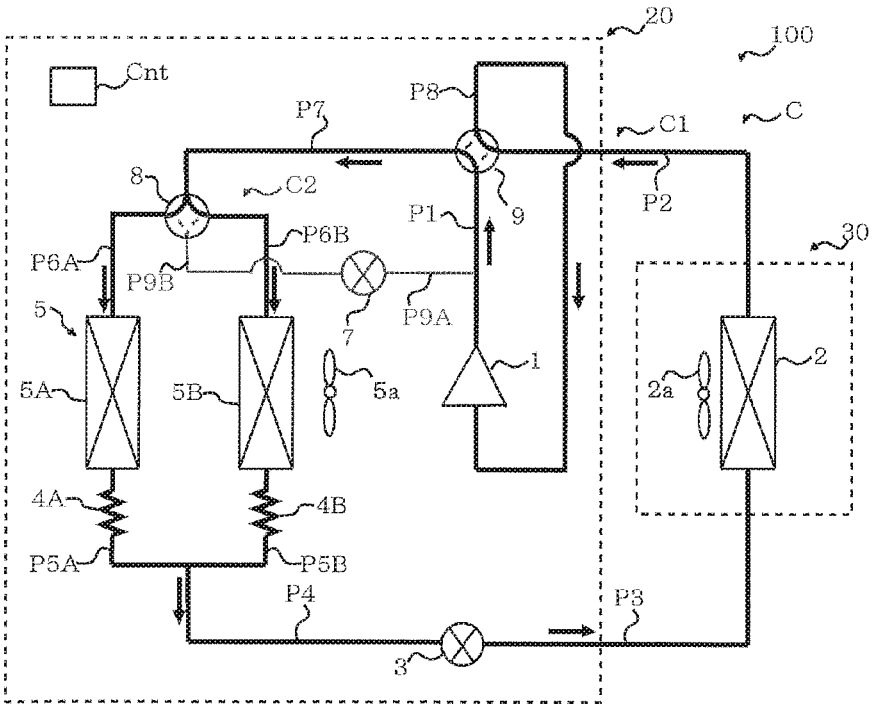
FIG. 6 is an action explanatory view of a cooling operation of the refrigeration cycle apparatus 100 according to the embodiment.

FIG. 6 is an action explanatory view of the cooling operation of the refrigeration cycle apparatus 100 according to the embodiment. In FIG. 6, the switching state of the switching device 8 is set to the third state. In FIG. 6, the flow passage switching valve 9 connects the discharge port of the compressor 1 and the switching device 8 to each other, and connects the indoor heat exchanger 2 and the suction port of the compressor 1 to each other. In FIG. 6, the valve 7 is in a closed state. In FIG. 6, the indoor fan 2*a* and the outdoor fan 5*a* are operated. The flow of refrigerant during the cooling operation is opposite to the flow of refrigerant during the heating operation described with reference to FIG. 5.

When the refrigeration cycle apparatus 100 continues the heating operation, an amount of frost formed on the outdoor heat exchanger 5 increases. Therefore, efficiency in heat exchange between air and refrigerant is reduced in the outdoor heat exchanger 5. In view of the above, the refrigeration cycle apparatus 100 starts the defrosting operation after a lapse of a predetermined time from the start of the heating operation. A defrosting method used in the defrosting operation of the refrigeration cycle apparatus 100 is a hot gas defrosting method where a hot gas discharged from the compressor 1 is supplied to the outdoor heat exchanger 5. The defrosting operation of the refrigeration cycle apparatus 100 includes a first defrosting control, a second defrosting control, and a third defrosting control. In the first defrosting control, defrosting of the lower heat exchanger 5A is performed. In the second defrosting control performed after the first defrosting control, defrosting of the upper heat exchanger 5B is performed. In the third defrosting control performed after the second defrosting control, defrosting of the lower heat exchanger 5A is performed.

Figure 7:
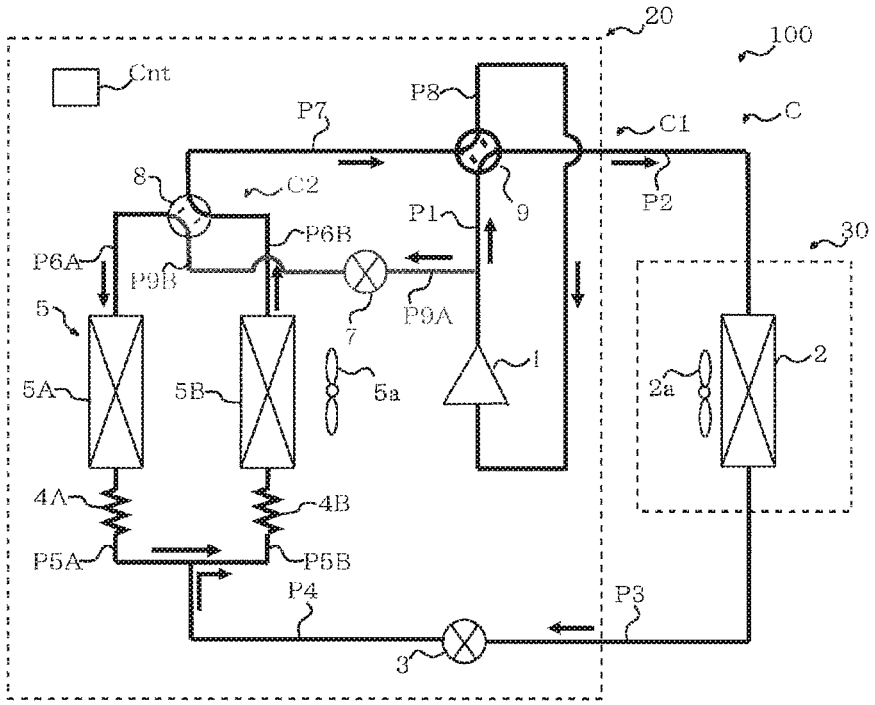
FIG. 7 is an action explanatory view of a first defrosting control of a defrosting operation of the refrigeration cycle apparatus 100 according to the embodiment.

FIG. 7 is an action explanatory view of the first defrosting control of the defrosting operation of the refrigeration cycle apparatus 100 according to the embodiment. In FIG. 7, the switching state of the switching device 8 is set to the first state. That is, the switching device 8 connects the discharge port of the compressor 1 and the lower heat exchanger 5A to each other, and connects the upper heat exchanger 5B and the flow passage switching valve 9 to each other. In this control state, the discharge port of the compressor 1 and the lower heat exchanger 5A are connected to each other via the pipe P1, the bypass C2, the switching device 8, and the pipe P6A. The upper heat exchanger 5B and the flow passage switching valve 9 are connected to each other via the pipe P6B, the switching device 8, and the pipe P7. In FIG. 7, the state of the flow passage switching valve 9 is the same as the state of the flow passage switching valve 9 during the heating operation described with reference to FIG. 5. In FIG. 7, the valve 7 is in an open state. Further, in FIG. 7, the indoor fan 2*a* and the outdoor fan 5*a* are operated.

A portion of refrigerant discharged from the compressor 1 passes through the flow passage switching valve 9 and, subsequently, flows into the indoor heat exchanger 2. The refrigerant flowing into the indoor heat exchanger 2 is liquefied. That is, also during the period when the first defrosting control is performed, the indoor heat exchanger 2 is used as a condenser and hence, warm air is supplied into a room from the indoor unit 30. The pressure of the refrigerant flowing out from the indoor heat exchanger 2 is reduced by the pressure reducing device 3. The refrigerant whose pressure is reduced by the pressure reducing device 3 is in a two-phase gas-liquid state.

Whereas the other portion of the refrigerant discharged from the compressor 1, that is, a hot gas, flows into the lower heat exchanger 5A via the bypass C2 and the switching device 8. Heat of the hot gas flowing into the lower heat exchanger 5A is supplied to frost on the lower heat exchanger 5A and, as a result, the frost on the lower heat exchanger 5A melts. The refrigerant flowing out from the lower heat exchanger 5A merges with the refrigerant whose pressure is reduced by the pressure reducing device 3.

The merged refrigerant flows into the upper heat exchanger 5B. The refrigerant flowing into the upper heat exchanger 5B is gasified. That is, during the first defrosting control, the upper heat exchanger 5B is used as an evaporator. The refrigerant flowing out from the upper heat exchanger 5B passes through the flow passage switching valve 9 and, subsequently, returns to the compressor 1.

Figure 8:
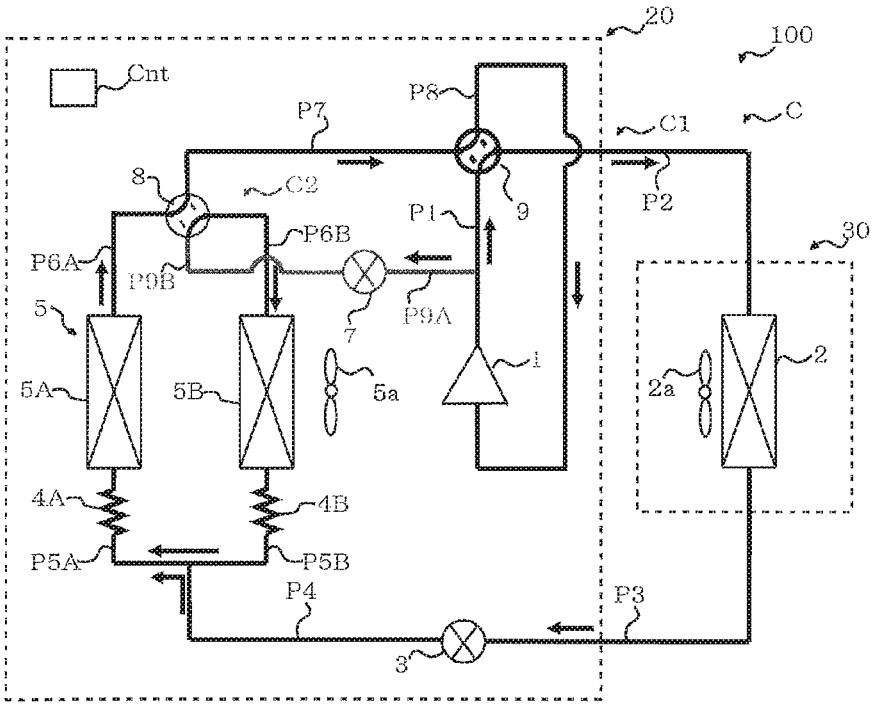
FIG. 8 is an action explanatory view of a second defrosting control of the defrosting operation of the refrigeration cycle apparatus 100 according to the embodiment.

FIG. 8 is an action explanatory view of the second defrosting control of the defrosting operation of the refrigeration cycle apparatus 100 according to the embodiment. In FIG. 8, the switching state of the switching device 8 is set to the second state, That is, the switching device 8 connects the discharge port of the compressor 1 and the upper heat exchanger 5B to each other, and connects the lower heat exchanger 5A and the flow passage switching valve 9 to each other. In this control state, the discharge port of the compressor 1 and the upper heat exchanger 5B are connected to each other via the pipe P1, the bypass C2, the switching device 8, and the pipe P6B. The lower heat exchanger 5A and the flow passage switching valve 9 are connected to each other via the pipe P6A, the switching device 8, and the pipe P7. In FIG. 8, the state of the flow passage switching valve 9 is the same as the state of the flow passage switching valve 9 during the heating operation described with reference to FIG. 5. In FIG. 8, the valve 7 is in an open state. In FIG. 8, the indoor fan 2*a* and the outdoor fan 5*a* are operated, A portion of the refrigerant discharged from the compressor 1 passes through the flow passage switching valve 9 and, subsequently, flows into the indoor heat exchanger 2. The refrigerant flowing into the indoor heat exchanger 2 is liquefied. That is, in the same manner as the first defrosting control, also during the period when the second defrosting control is performed, the indoor heat exchanger 2 is used as a condenser and hence, warm air is supplied into the room from the indoor unit 30. The pressure of the refrigerant flowing out from the indoor heat exchanger 2 is reduced by the pressure reducing device 3. The refrigerant whose pressure is reduced by the pressure reducing device 3 is in a two-phase gas-liquid state.

Whereas the other portion of the refrigerant discharged from the compressor 1, that is, a hot gas, flows into the upper heat exchanger 5B via the bypass C2 and the switching device 8. Heat of the hot gas flowing into the upper heat exchanger 5B is supplied to frost on the upper heat exchanger 5B and, as a result, the frost on the upper heat exchanger 5B melts. The refrigerant flowing out from the upper heat exchanger 5B merges with the refrigerant whose pressure is reduced by the pressure reducing device 3.

The merged refrigerant flows into the lower heat exchanger 5A. The refrigerant flowing into the lower heat exchanger 5A is gasified. That is, during the second defrosting control, the lower heat exchanger 5A is used as an evaporator. The refrigerant flowing out from the lower heat exchanger 5A passes through the flow passage switching valve 9 and, subsequently, returns to the compressor 1.

Figure 9:
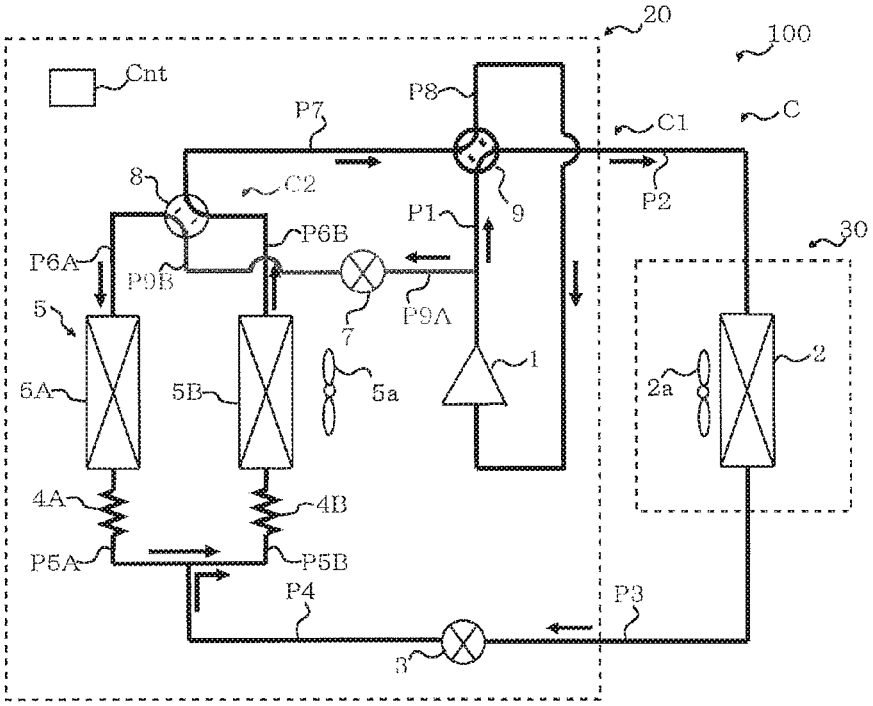
FIG. 9 is an action explanatory view of a third defrosting control of the defrosting operation of the refrigeration cycle apparatus 100 according to the embodiment.

FIG. 9 is an action explanatory view of the third defrosting control of the defrosting operation of the refrigeration cycle apparatus 100 according to the embodiment. The action state of the third defrosting control shown in FIG. 9 is the same as the action state of the first defrosting control shown in FIG. 7. That is, in FIG. 9, the switching state of the switching device 8 is set to the first state. That is, the switching state of the switching device 8 during the third defrosting control is the same as the switching state of the switching device 8 during the first defrosting control. Further, in FIG. 9, the state of the flow passage switching valve 9 is the same as the state of the flow passage switching valve 9 during the heating operation described with reference to FIG. 5. In FIG. 9, the valve 7 is in an open state. In FIG. 9, the indoor fan 2*a* and the outdoor fan 5*a* are operated. The flow of refrigerant during the third defrosting control is substantially equal to the flow of refrigerant during the first defrosting control and hence, the description of the flow of refrigerant during the third defrosting control is omitted.

Figure 10:
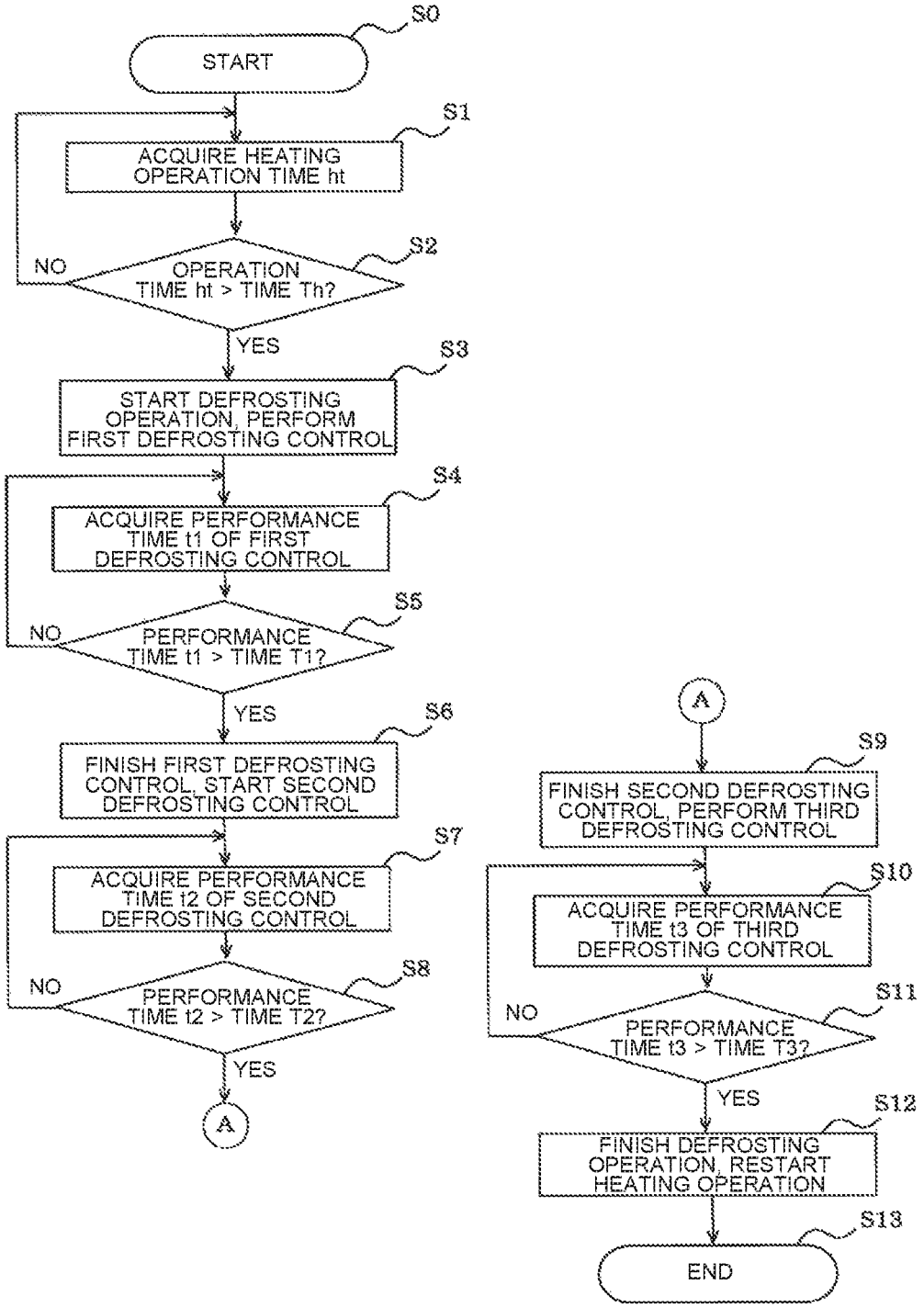
FIG. 10 is a control flowchart of the refrigeration cycle apparatus 100 according to the embodiment.

FIG. 10 is a control flowchart of the refrigeration cycle apparatus 100 according to the embodiment.

The controller Cnt starts a control flow of the defrosting operation (step S0). The controller Cnt acquires a time elapsed from the start of the heating operation, that is, a heating operation time ht (step S1). The arithmetic unit 50A of the controller Cnt determines whether or not the heating operation time ht is longer than a predetermined time Th (step S2). When the heating operation time ht is longer than the predetermined time Th, the controller Cnt starts the defrosting operation (step S3). In step S3, the controller Cnt performs the first defrosting control. That is, the controller CM switches the switching state of the switching device 8 from the third state to the first state, and sets the valve 7 to an open state. Further, the controller Cnt maintains the state of the flow passage switching valve 9.

The controller Cnt acquires a time elapsed from the start of the first defrosting control, that is, a performance time t1 of the first defrosting control (step S4). The arithmetic unit 50A of the controller Cnt determines whether or not the performance time t1 is longer than a predetermined time T1 (step S5). When the performance time t1 is longer than the predetermined time T1, the controller Cnt finishes the first defrosting control, and starts the second defrosting control (step S6). That is, the controller Cnt switches the switching state of the switching device 8 from the first state to the second state. Further, the controller Cnt maintains the open state of the valve 7, and maintains the state of the flow passage switching valve 9.

The controller Cnt acquires a time elapsed from the start of the second defrosting control, that is, a performance time t2 of the second defrosting control (step S7). The arithmetic unit 50A of the controller Cnt determines whether or not the performance time t2 is longer than a predetermined time T2 (step S8). The time T1 is shorter than the time T2. That is, the performance time of the first defrosting control is shorter than the performance time of the second defrosting control. When the performance time t2 is longer than the predetermined time T2, the controller Cnt finishes the second defrosting control, and starts the third defrosting control (step S9). That is, the controller Cnt switches the switching state of the switching device 8 from the second state to the first state. Further, the controller Cnt maintains the open state of the valve 7, and maintains the state of the flow passage switching valve 9.

The controller Cnt acquires a time elapsed from the start of the third defrosting control, that is, a performance time t3 of the third defrosting control (step S10). The arithmetic unit 50A of the controller Cnt determines whether or not the performance time t3 is longer than a predetermined time T3 (step S11). The time T1 is shorter than the time T3. That is, the performance time of the first defrosting control is shorter than the performance time of the third defrosting control. When the performance time t3 is longer than the predetermined time T3, the controller Cnt finishes the third defrosting control (step S12). In step S12, the controller Cnt finishes the defrosting operation, and restarts the heating operation. That is, the controller Cnt switches the switching state of the switching device 8 from the first state to the third state, and sets the valve 7 to a closed state. Further, the controller Cnt maintains the state of the flow passage switching valve 9. The controller Cnt finishes the control flow of the defrosting operation (step S13).

Figure 11:
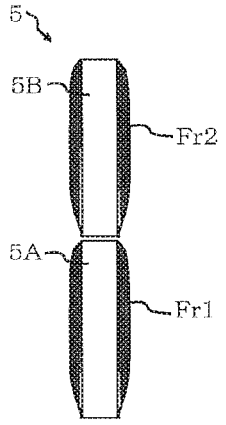
FIG. 11 is a schematic view showing a state of frost Fr1 formed on a lower heat exchanger 5A during the heating operation and a state of frost Fr2 formed on an upper heat exchanger 5B during the heating operation.

FIG. 11 is a schematic view showing a state of frost Fr1 formed on the lower heat exchanger 5A during the heating operation and a state of frost Fr2 formed on the upper heat exchanger 5B during the heating operation. As shown in FIG. 11, when the heating operation is continued, the frost Fr1 is formed on the lower heat exchanger 5A, and the frost Fr2 is formed on the upper heat exchanger 5B. As the volume of the lower heat exchanger 5A and the volume of the upper heat exchanger 5B are equal to each other, for convenience of the description, an amount of the frost Fr1 and an amount of the frost Fr2 are defined to be equal to each other.

Figure 12:
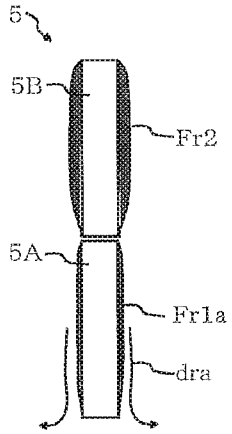
FIG. 12 is a schematic view showing a manner in which frost Fr1*a* on the lower heat exchanger 5A melts during the period when the first defrosting control is performed.

FIG. 12 is a schematic view showing a manner in which frost Fr1*a* on the lower heat exchanger 5A melts during the period when the first defrosting control is performed. By performing the first defrosting control, the frost Fr1 melts, so that water dra flows down. When the amount of the frost Fr1 is small, the frost Fr1 may completely melt. However, in the description made in this embodiment, the frost Fr1 is defined to remain partially unmelted. That is, by performing the first defrosting control, a portion of the frost Fr1 melts.

Figure 13:
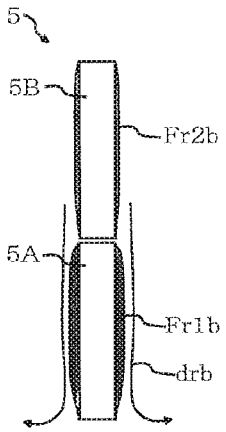
FIG. 13 is a schematic view showing a manner in which frost Fr2*b* on the upper heat exchanger 5B melts and a manner in which water drb is refrozen on the lower heat exchanger 5A during the period when the second defrosting control is performed.

FIG. 13 is a schematic view showing a manner in which frost Fr2*b* on the upper heat exchanger 5B melts and a manner in which water drb is refrozen on the lower heat exchanger 5A during the period when the second defrosting control is performed. By performing the second defrosting control, the frost Fr2 shown in FIG. 12 melts, thus forming the frost Fr2*b*. When the frost Fr2 shown in FIG. 12 melts, the water drb flows down from the upper heat exchanger 5B to the lower heat exchanger 5A. The water drb flowing down is cooled by the lower heat exchanger 5A, which is used as an evaporator, and by frost remaining unmelted on the lower heat exchanger 5A.

Figure 14:
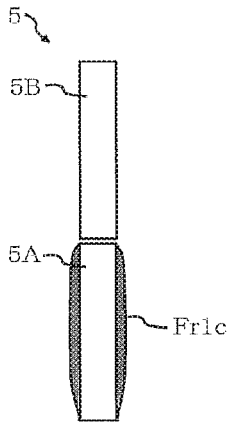
FIG. 14 is a schematic view showing a state of frost Fr1*c* remaining on the lower heat exchanger 5A at the time when the second defrosting control is finished.

FIG. 14 is a schematic view showing a state of frost Fr1*c* remaining on the lower heat exchanger 5A at the time when the second defrosting control is finished. The performance time of the second defrosting control is longer than the performance time of the first defrosting control. Therefore, an amount of frost that can be caused to be melted by performing the second defrosting control is larger than an amount of frost that can be caused to be melted by performing the first defrosting control. In FIG. 14, the frost Fr2*b* shown in FIG. 13 is caused to be completely melted. Whereas the water drb shown in FIG. 13 is frozen on the surface of the lower heat exchanger 5A, or is frozen by frost formed on the lower heat exchanger 5A. In particular, when the water drb is frozen by frost formed on the lower heat exchanger 5A, the thickness of frost on the lower heat exchanger 5A increases, so that an amount of frost not in contact with the lower heat exchanger 5A, which is a heat source, increases. However, the first defrosting control is performed before the second defrosting control is performed and hence, frost on the lower heat exchanger 5A is prevented from having a large thickness at the time of starting the third defrosting operation.

Figure 15:
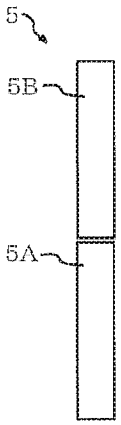
FIG. 15 is a schematic view showing the outdoor heat exchanger 5 at the time when the third defrosting control is finished.

FIG. 15 is a schematic view showing the outdoor heat exchanger 5 at the time when the third defrosting control is finished. As described above, frost on the lower heat exchanger 5A is prevented from having a large thickness at the time of starting the third defrosting operation, Therefore, by performing the third defrosting control, the frost Fr1*c* shown in FIG. 14 melts.

Advantageous Effects of Embodiment

An existing refrigeration cycle apparatus performs defrosting of an upper heat exchanger and, subsequently, performs defrosting of a lower heat exchanger. That is, defrosting of the outdoor heat exchanger of the existing refrigeration cycle apparatus is two-stage defrosting including defrosting of the upper heat exchanger and defrosting of the lower heat exchanger. In the defrosting operation of the existing refrigeration cycle apparatus, when defrosting of the upper heat exchanger is performed, water flowing down from the upper heat exchanger comes into contact with frost on the lower heat exchanger, so that the water flowing down from the upper heat exchanger is frozen by the frost on the lower heat exchanger. As a result, the thickness of frost on the lower heat exchanger at the time of starting defrosting of the lower heat exchanger becomes larger than the thickness of frost on the lower heat exchanger at the time of starting defrosting of the upper heat exchanger. Frost on contact with the lower heat exchanger directly receives heat from the lower heat exchanger, so that the frost on contact with the lower heat exchanger easily melts. Whereas frost not in contact with the lower heat exchanger, for example, the outer portion of the frost on the lower heat exchanger receives heat transferred through the frost or other object in contact with the lower heat exchanger. Therefore, the outer portion of the frost on the lower heat exchanger does not easily melt. As the thickness of frost on the lower heat exchanger increases, an amount of frost not in contact with the lower heat exchanger increases. Accordingly, an increase in thickness of frost on the lower heat exchanger increases a possibility of a reduction in defrosting efficiency of the lower heat exchanger. However, the controller Cnt of the refrigeration cycle apparatus 100 performs the first defrosting control before the controller Cnt performs the second defrosting control. Therefore, frost on the lower heat exchanger 5A is prevented from having an increased thickness at the time of starting the third defrosting control and, as a result, it is possible to suppress a reduction in defrosting efficiency of the lower heat exchanger 5A during the third defrosting control. Accordingly, at the time of finishing the third defrosting control, an amount of frost remaining unmelted on the lower heat exchanger 5A can be reduced. The controller Cnt restarts the heating operation after the controller Cnt performs the third defrosting control. The amount of frost remaining unmelted on the lower heat exchanger 5A is reduced at the time of finishing the third defrosting control and hence, during the period when the restarted heating operation is performed, it is possible to suppress the inhibition of heat exchange between refrigerant in the heat transfer tube hpA of the lower heat exchanger 5A and air passing through the lower heat exchanger 5A. Therefore, it is possible to suppress a reduction in efficiency of heat exchange of the lower heat exchanger 5A during the period when the heating operation restarted after the defrosting operation is performed. As a result, it is possible to suppress a reduction in efficiency of the heating operation of the refrigeration cycle apparatus 100.

The above-mentioned advantageous effects are additionally described by giving examples. The total time of the performance time of the first defrosting control and the performance time of the third defrosting control is defined as X hours, and the performance time of the second defrosting control is defined as Y hours. Further, the defrosting time of the lower heat exchanger of the existing refrigeration cycle apparatus is defined as X hours, and the defrosting time of the upper heat exchanger of the existing refrigeration cycle apparatus is defined as Y hours. In this manner, when the defrosting time of the refrigeration cycle apparatus 100 and the defrosting time of the existing refrigeration cycle apparatus are equal to each other, the amount of frost remaining unmelted on the lower heat exchanger 5A of the refrigeration cycle apparatus 100 is reduced compared with the amount of frost remaining unmelted on the lower heat exchanger of the existing refrigeration cycle apparatus. The reason is as follows. As described above, the controller Cnt of the refrigeration cycle apparatus 100 performs the first defrosting control before the controller Cnt performs the second defrosting control. Therefore, frost on the lower heat exchanger 5A is prevented from having a large thickness at the time of starting the third defrosting control. As a result, it is possible to suppress a reduction in defrosting efficiency of the lower heat exchanger 5A during the third defrosting control.

In the embodiment, the performance time of the third defrosting control of the refrigeration cycle apparatus 100 is predetermined. However, as described above, frost on the lower heat exchanger 5A is prevented from having a large thickness at the time of starting the third defrosting control and hence, a manager of the refrigeration cycle apparatus 100 is not required to set the performance time of the third defrosting control to a time longer than necessary because of concern for frost remaining unmelted on the lower heat exchanger 5A. That is, the refrigeration cycle apparatus 100 is configured to easily allow setting of a short time for the defrosting operation. When a time of the defrosting operation can be shortened, it is possible to reduce a delay of timing for returning from the defrosting operation to the heating operation by a corresponding amount. Therefore, in the refrigeration cycle apparatus 100, it is possible to suppress a reduction in the ratio of a time of the heating operation to a total operation time including the time of the heating operation and the time of the defrosting operation. Accordingly, the refrigeration cycle apparatus 100 has an advantageous effect of suppressing a reduction in temperature of the room.

During the period when the refrigeration cycle apparatus 100 performs the defrosting operation, the indoor heat exchanger 2 is used as a condenser. Specifically, during the period when the controller Cnt performs the first defrosting control, the second defrosting control, and the third defrosting control, the indoor heat exchanger 2 is used as a condenser. Therefore, the refrigeration cycle apparatus 100 can perform the heating operation of the room with the indoor unit 30 while performing the defrosting operation of the outdoor heat exchanger 5 with the outdoor unit 20.

In this embodiment, for convenience of the description, both in the case where the performance time of the third defrosting control is shorter than the performance time of the first defrosting control and the case where the performance time of the first defrosting control is shorter than the performance time of the third defrosting control, the total time of the performance time of the first defrosting control and the performance time of the third defrosting control is defined to be a fixed time. When the performance time of the third defrosting control is shorter than the performance time of the first defrosting control, an amount of frost melting on the lower heat exchanger 5A during the first defrosting control increases by an amount that corresponds to a longer performance time of the first defrosting control. At this point of operation, when the second defrosting control is performed, the amount of frost formed on the lower heat exchanger 5A increases. Therefore, when the performance time of the third defrosting control is shorter than the performance time of the first defrosting control, frost on the lower heat exchanger 5A tends to remain unmelted at the time of finishing the third defrosting control by an amount that corresponds to a shorter performance time of the third defrosting control. In view of the above, in the refrigeration cycle apparatus 100, the performance time of the first defrosting control is shorter than the performance time of the third defrosting control. In other words, in the refrigeration cycle apparatus 100, the performance time of the third defrosting control is longer than the performance time of the first defrosting control. Therefore, even when the amount of frost formed on the lower heat exchanger 5A increases because of performing the second defrosting control, frost on the lower heat exchanger 5A is prevented from easily remaining unmelted at the time of finishing the third defrosting control. That is, the performance time of the third defrosting control is longer than the performance time of the first defrosting control and hence, the refrigeration cycle apparatus 100 has an advantageous effect of preventing frost on the lower heat exchanger 5A from easily remaining unmelted at the time of finishing the third defrosting control.

As the amount of frost formed on the upper heat exchanger 5B increases, the amount of water flowing down from the upper heat exchanger 5B to the lower heat exchanger 5A increases during the second defrosting control. Therefore, as the amount of frost formed on the upper heat exchanger 5B increases, the amount of frost formed on the lower heat exchanger 5A at the time of starting the third defrosting control is likely to increase. Therefore, when the amount of frost formed on the upper heat exchanger 5B increases, the above-mentioned effect of preventing frost on the lower heat exchanger 5A from easily remaining unmelted at the time of finishing the third defrosting control is more remarkable.

In the case where the performance time of the first defrosting control is set to an excessively long time, defrosting of the lower heat exchanger 5A is performed even after frost on the lower heat exchanger 5A completely melts. That is, when the performance time of the first defrosting control is set to an excessively long time, the ratio of a time during which frost is not caused to be melted, that is, a waste time, to the performance time of the first defrosting control increases. In view of the above, in the refrigeration cycle apparatus 100, the performance time of the first defrosting control is shorter than the performance time of the second defrosting control. As described above, the performance time of the first defrosting control is reduced and hence, the refrigeration cycle apparatus 100 can obtain an advantageous effect of suppressing an increase in the ratio of a time during which frost is not caused to be melted to the performance time of the first defrosting control.

The controller Cnt starts the defrosting operation after a lapse of a predetermined time from the start of the heating operation. That is, it is unnecessary for the refrigeration cycle apparatus 100 to include a temperature sensor used for determining whether or not the controller Cnt starts the defrosting operation. Therefore, manufacturing costs for the refrigeration cycle apparatus 100 is reduced.

The refrigeration cycle apparatus 100 includes the switching device 8, the bypass pipe P9A, the bypass pipe P9B, and the valve 7. The controller Cnt sets the valve 7 to a closed state during the heating operation. With such an operation, during the heating operation, a hot gas is not supplied to the bypass C2, but is supplied to the indoor heat exchanger 2. As a result, the indoor heat exchanger 2 is used as a condenser, and the outdoor heat exchanger 5 is used as an evaporator. Further, the controller Cnt sets the switching state of the switching device 8 to the first state or the second state, and sets the valve 7 to an open state during the defrosting operation. With such operations, during the defrosting operation, a hot gas is supplied to the bypass C2 and the indoor heat exchanger 2. As a result, the indoor heat exchanger 2 is used as a condenser, one of the lower heat exchanger 5A and the upper heat exchanger 5B is subjected to defrosting, and the other of the lower heat exchanger 5A and the upper heat exchanger 5B is used as an evaporator.

<Modification 1 of Embodiment>

Figure 16:
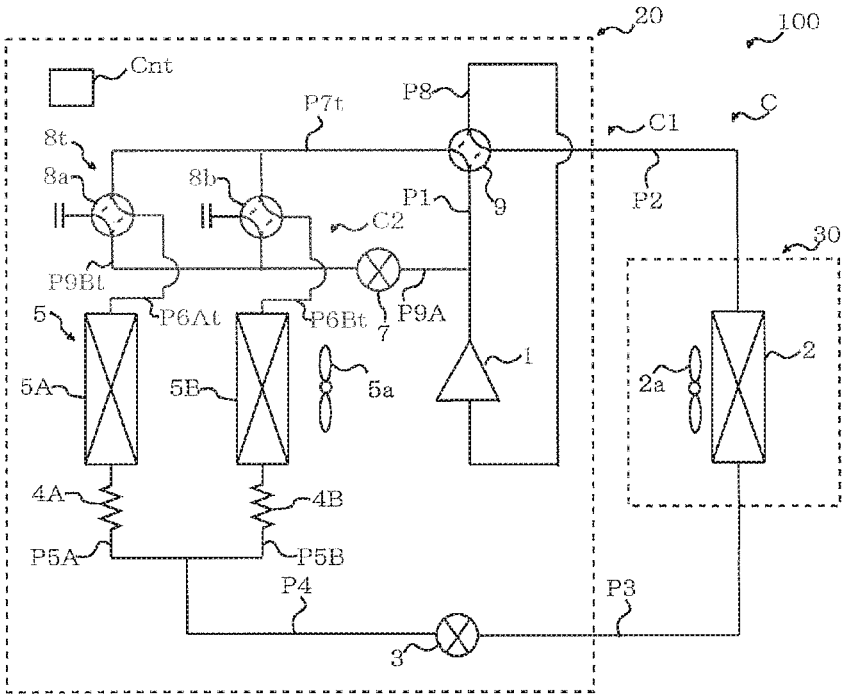
FIG. 16 is a refrigerant circuit diagram of a modification 1 of the refrigeration cycle apparatus 100 according to the embodiment.

FIG. 16 is a refrigerant circuit diagram of a modification 1 of the refrigeration cycle apparatus 100 according to the embodiment. The switching device 8 is configured to switch a switching state to one of the first state, the second state, and the third state. A switching device 8*t* in the modification 1 includes a three-way valve 8*a* and a three-way valve 8*b*. The switching device 8*t* also has a similar function to the switching device 8. A bypass pipe P9Bt in the modification 1 is connected to the three-way valve 8*a* and the three-way valve 8*b*. A pipe P6At in the modification 1 connects the three-way valve 8*a* and the lower heat exchanger 5A to each other, and a pipe P6Bt in the modification 1 connects the three-way valve 8*b* and the upper heat exchanger 5B to each other.

The three-way valve 8*a* switches a state to one of a state A and a state B. In the state A, the discharge port of the compressor 1 and the lower heat exchanger 5A are connected to each other. In the state B, the lower heat exchanger 5A and the flow passage switching valve 9 are connected to each other. The three-way valve 8*b* switches a state to one of a state C and a state D. In the state C, the discharge port of the compressor 1 and the upper heat exchanger 5B are connected to each other. In the state D, the upper heat exchanger 5B and the flow passage switching valve 9 are connected to each other. During the heating operation and the cooling operation, the controller Cnt sets the three-way valve 8*a* to the state B, and sets the three-way valve 8*b* to the state D. During the first defrosting control and the third defrosting control, the controller Cnt sets the three-way valve 8*a* to the state A, and sets the three-way valve 8*b* to the state D. Further, during the second defrosting control, the controller Cnt sets the three-way valve 8*a* to the state B, and sets the three-way valve 8*b* to the state C. This modification 1 also has an advantageous effect substantially equal to the advantageous effect obtained by the refrigeration cycle apparatus 100 according to the embodiment.

<Modification 2 of Embodiment>

Figure 17:
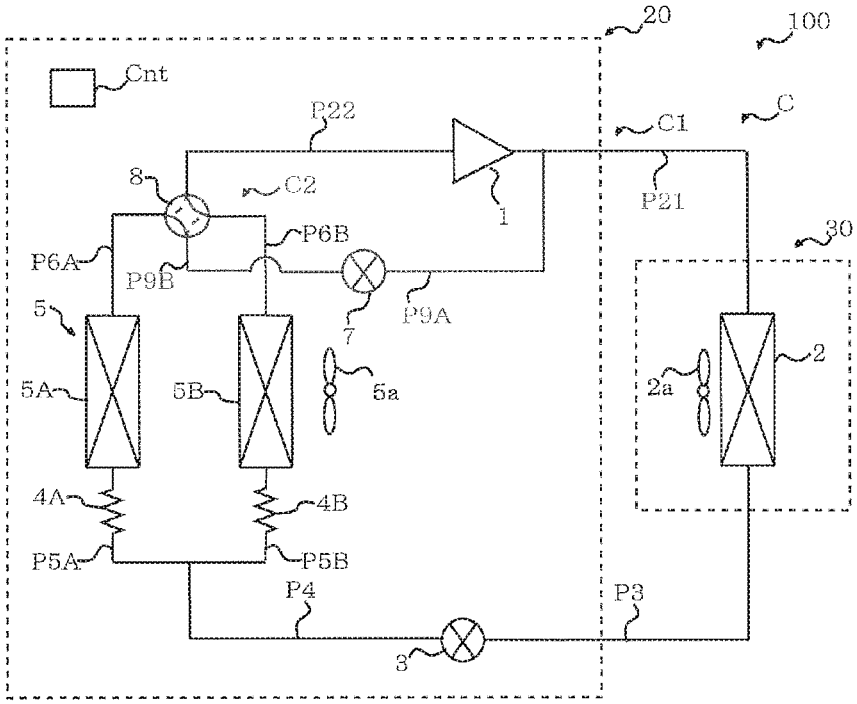
FIG. 17 is a refrigerant circuit diagram of a modification 2 of the refrigeration cycle apparatus 100 according to the embodiment.

FIG. 17 is a refrigerant circuit diagram of a modification 2 of the refrigeration cycle apparatus 100 according to the embodiment. The refrigeration cycle apparatus 100 of the embodiment is configured to switch an operation to one of the heating operation and the cooling operation. The modification 2 does not include the flow passage switching valve 9. Therefore, in the modification 2, the heating operation can be performed, but the cooling operation cannot be performed. This modification 2 also has an advantageous effect substantially equal to the advantageous effect obtained by the refrigeration cycle apparatus 100 according to the embodiment.

<Modification 3 of Embodiment>

Figure 18:
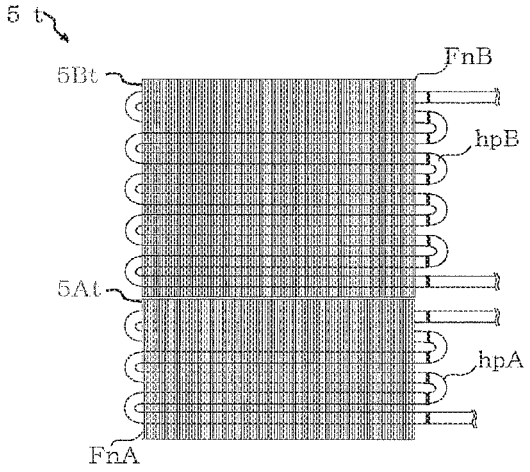
FIG. 18 is a schematic view of an outdoor heat exchanger 5*t* of a modification 3 of the refrigeration cycle apparatus 100 according to the embodiment.

FIG. 18 is a schematic view of an outdoor heat exchanger 5*t* of a modification 3 of the refrigeration cycle apparatus 100 according to the embodiment. In the refrigeration cycle apparatus 100 of the embodiment, the volume of the lower heat exchanger 5A and the volume of the upper heat exchanger 5B are equal to each other. In the modification 3, the volume of a lower heat exchanger 5At is smaller than the volume of an upper heat exchanger 5Bt. Note that a volume obtained by summing the volume of the lower heat exchanger 5At and the volume of the upper heat exchanger 5Bt is equal to a volume obtained by summing the volume of the lower heat exchanger 5A and the volume of the upper heat exchanger 5B.

The volume of the lower heat exchanger 5At is smaller than the volume of the upper heat exchanger 5Bt, so that the amount of frost formed on the lower heat exchanger 5At at the time of starting the defrosting operation is smaller than the amount of frost formed on the upper heat exchanger 5Bt at the time of starting the defrosting operation. A quantity of heat supplied to the lower heat exchanger 5A per unit time during the first defrosting control and the third defrosting control is defined to be substantially equal to a quantity of heat supplied to the lower heat exchanger 5A per unit time during the second defrosting control. In this case, the quantity of heat that frost per unit mass on the lower heat exchanger 5At receives from the lower heat exchanger 5At per unit time during the third defrosting control is greater than the quantity of heat that frost per unit mass on the upper heat exchanger 5Bt receives from the upper heat exchanger 5Bt per unit time during the second defrosting control. That is, defrosting efficiency of the third defrosting control is increased compared with defrosting efficiency of the second defrosting control. The amount of frost on the lower heat exchanger 5At increases because of the second defrosting control, so that there is a high demand for an increase in the defrosting efficiency of the third defrosting control. Defrosting efficiency of the third defrosting control in the modification 3 is increased as described above and hence, at the time of finishing the third defrosting control, the amount of frost remaining unmelted on the lower heat exchanger 5A is reduced.

Further, the quantity of heat that frost per unit mass on the lower heat exchanger 5At receives from the lower heat exchanger 5At per unit time during the first defrosting control is greater than the quantity of heat that frost per unit mass on the upper heat exchanger 5Bt receives from the upper heat exchanger 5Bt per unit time during the second defrosting control. That is, defrosting efficiency of the first defrosting control is also increased compared with defrosting efficiency of the second defrosting control. As a result, at the time of starting the third defrosting control, the amount of frost formed on the lower heat exchanger 5A is reduced. Accordingly, at the time of finishing the third defrosting control, the amount of frost remaining unmelted on the lower heat exchanger 5A is further reduced.

REFERENCE SIGNS LIST

1 compressor 2 indoor heat exchanger 2*a* indoor fan 3 pressure reducing device 4A capillary tube 4B capillary tube 5 outdoor heat exchanger 5A lower heat exchanger 5At lower heat exchanger 5B upper heat exchanger 5Bt upper heat exchanger 5*a* outdoor fan 5*t* outdoor heat exchanger 7 valve 8 switching device 8*a* three-way valve 8*b* three-way valve 8*t* switching device 9 flow passage switching valve 20 outdoor unit 30 indoor unit 50 memory unit 50A arithmetic unit 50B control unit 50C memory unit 100 refrigeration cycle apparatus C refrigerant circuit C1 main circuit C2 bypass Cnt controller FnA fin FnB fin P1 pipe P2 pipe P3 pipe P4 pipe P5A pipe P5B pipe P6A pipe P6At pipe P6B pipe P6Bt pipe P7 pipe P8 pipe P9A bypass pipe P9B bypass pipe P9Bt bypass pipe hpA heat transfer tubehpB heat transfer tube

The invention claimed is:

1. An air-conditioning apparatus, comprising:

a compressor;

an indoor heat exchanger used as a condenser during a heating operation;

an outdoor heat exchanger including a lower heat exchanger and an upper heat exchanger stacked on top of the lower heat exchanger, the outdoor heat exchanger being used as an evaporator during the heating operation;

an outdoor fan configured to supply air to the outdoor heat exchanger;

a pressure reducing device provided downstream of the indoor heat exchanger in a direction in which refrigerant flows during the heating operation, the pressure reducing device being provided upstream of the outdoor heat exchanger in the direction in which refrigerant flows during the heating operation;

a switching device configured to switch a switching state to one of a first state and a second state, a discharge port of the compressor and an intake of the lower heat exchanger being connected to each other in the first state in which the lower heat exchanger receives heated refrigerant, the indoor heat exchanger is used as the condenser and the upper heat exchanger is used as the evaporator; the discharge port of the compressor and an intake of the upper heat exchanger being connected to each other in the second state in which the upper heat exchanger receives heated refrigerant, the indoor heat exchanger is used as the condenser and the lower heat exchanger is used as the evaporator; and a controller configured to control the switching state of the switching device, perform a defrosting operation in which frost on the outdoor heat exchanger is caused to be melted, consisting of three defrosting controls, including operate the outdoor fan, initially, perform a first defrosting control for a first predetermined performance time for at least partial melting of frost on the lower heat exchanger, in which the switching state of the switching device is set to the first state, responsive to finishing the first defrosting control, perform a second defrosting control for a second predetermined performance time for melting of frost on the upper heat exchanger to re-freeze on the lower heat exchanger, in which the switching state of the switching device is set to the second state, responsive to finishing the second defrosting control, perform a third defrosting control for a third predetermined performance time for melting of frost and refrozen upper heat exchanger melt water on the lower heat exchanger, in which the switching state of the switching device is set to the first state, the first predetermined performance time is shorter than the third predetermined performance time, and responsive to finishing the third defrosting control, restart the heating operation.

2. The air-conditioning apparatus of claim 1, wherein during the first defrosting control and the third defrosting control, the indoor heat exchanger is used as a condenser, and the upper heat exchanger is used as an evaporator, and during the second defrosting control, the indoor heat exchanger is used as a condenser, and the lower heat exchanger is used as an evaporator.

3. The air-conditioning apparatus of claim 1, wherein the first predetermined performance time of the first defrosting control is shorter than the second predetermined performance time of the second defrosting control.

4. The air-conditioning apparatus of claim 1, wherein the controller is configured to start the defrosting operation after a lapse of a predetermined time from a start of the heating operation.

5. The air-conditioning apparatus of claim 1, further comprising:

a bypass pipe that connects the discharge port of the compressor and the switching device to each other; and a valve provided to the bypass pipe, wherein the controller is configured to set the valve to a closed state during the heating operation, and set the valve to an open state during the defrosting operation.

6. The air-conditioning apparatus of claim 1, wherein a volume of the lower heat exchanger is smaller than a volume of the upper heat exchanger.

7. The air-conditioning apparatus of claim 1, wherein the controller is further configured to acquire a time elapsed from the start of the first defrosting control, determine whether or not the time elapsed from the start of the first defrosting control is greater than the first predetermined performance time, and when the time elapsed from the start of the first defrosting control is greater than the first predetermined performance time, end the first defrosting control and start the second defrosting control.

8. The air-conditioning apparatus of claim 7, wherein the controller is further configured to acquire a time elapsed from the start of the second defrosting control, determine whether or not the time elapsed from the start of the second defrosting control is greater than the second predetermined performance time, and when the time elapsed from the start of the second defrosting control is greater than the second predetermined performance time, end the second defrosting control and start the third defrosting control.

9. The air-conditioning apparatus of claim 8, wherein the controller is further configured to acquire a time elapsed from the start of the third defrosting control, determine whether or not the time elapsed from the start of the third defrosting control is greater than the third predetermined performance time, and when the time elapsed from the start of the third defrosting control is greater than the third predetermined performance time, end the third defrosting control and restart the heating operation.

10. The air-conditioning apparatus of claim 1, wherein the controller is further configured to acquire a time elapsed from the start of the second defrosting control, determine whether or not the time elapsed from the start of the second defrosting control is greater than the second predetermined performance time, and when the time elapsed from the start of the second defrosting control is greater than the second predetermined performance time, end the second defrosting control and start the third defrosting control.

* * * * *